US011896913B1

(12) United States Patent
Coulter

(10) Patent No.: US 11,896,913 B1
(45) Date of Patent: Feb. 13, 2024

(54) MULTI-DIMENSIONAL ROTATING MODIFIED CHESS GAME

(71) Applicant: Craig Wallace Coulter, Denver, CO (US)

(72) Inventor: Craig Wallace Coulter, Denver, CO (US)

( * ) Notice: Subject to any disclaimer, the term of this patent is extended or adjusted under 35 U.S.C. 154(b) by 0 days.

(21) Appl. No.: 17/952,110

(22) Filed: Sep. 23, 2022

(51) Int. Cl.
*A63F 3/02* (2006.01)
*A63F 3/00* (2006.01)

(52) U.S. Cl.
CPC ..... *A63F 3/02* (2013.01); *A63F 3/00261* (2013.01); *A63F 3/00533* (2013.01); *A63F 2003/0057* (2013.01); *A63F 2003/00287* (2013.01); *A63F 2003/00545* (2013.01); *A63F 2003/00996* (2013.01)

(58) Field of Classification Search
CPC .... A63F 3/02; A63F 3/00261; A63F 3/00533; A63F 2003/00287; A63F 2003/00545; A63F 2003/0057; A63F 2003/00996
See application file for complete search history.

(56) References Cited

U.S. PATENT DOCUMENTS 4,249,740 A * 2/1981 Cheney ..... A63F 3/02 273/288
4,875,687 A * 10/1989 Alsip ..... A63F 3/00574 273/271
6,131,929 A * 10/2000 Haley ..... A63F 9/001 296/22
2008/0296838 A1* 12/2008 Peterson ..... A63F 3/00214 273/261
2011/0127720 A1* 6/2011 Fourcell ..... A63F 9/00 273/309
2014/0333023 A1* 11/2014 Rusha ..... A63F 3/02 273/261
2019/0176021 A1* 6/2019 Roehrig ..... A63F 3/02
2020/0078662 A1* 3/2020 Simmons ..... A63F 3/00176
2021/0077897 A1* 3/2021 Simmons ..... A63F 3/00214
2022/0280864 A1* 9/2022 Kerwin ..... A63F 3/0023

* cited by examiner

*Primary Examiner* — William H McCulloch, Jr.
*Assistant Examiner* — Ankit B Doshi
(74) *Attorney, Agent, or Firm* — Kondori & Moorad, LLP; Waseem Moorad; Saloni Rastogi

(57) ABSTRACT

A chess-like game played by at least two or as many players as possible on a non-polyhedron or a polyhedron rotating surface wherein a number of chess boards are connected to each other, back-to-back and wrapped around the said rotating surface so that the rows of at least two chess boards are parallel.

14 Claims, 13 Drawing Sheets

MULTI-DIMENSIONAL ROTATING MODIFIED CHESS GAME

FIELD OF THE INVENTION

Figure 1:
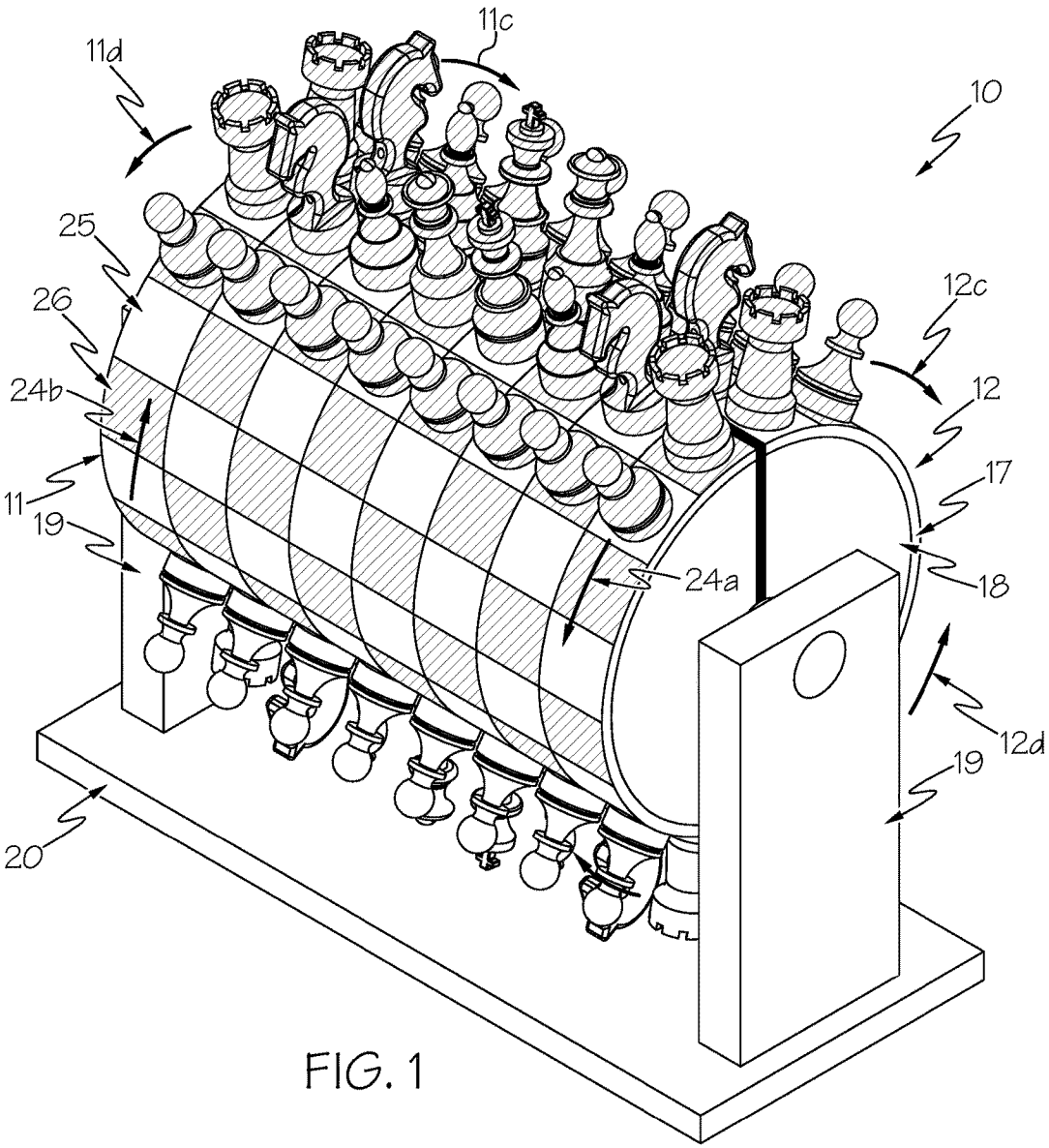

The invention relates to a chess-like game, and more particularly to a new and expanded chess variant that can be played by multiple groups or players on one surface at one time. The invention further relates to a chess-like game played on a rotating surface wherein chess boards are connected back-to-back and wrapped around the said surface so that the rows of the chess boards are parallel.

BACKGROUND OF THE INVENTION

Chess is one of the most popular games worldwide. Many variations and modifications have been made in the past. However, there is a need for a variation wherein many players can play at the same time as it is with many other popular games.

Further, chess fans are always looking for new rules and new strategies to play efficiently and competitively. The variations claimed in the present invention distinguishes this chess-like game from conventional chess or other chess variants. This chess-like game as disclosed herein is undoubtedly much different and much more challenging than any other chess variants because the multiple chess boards allow for an endless amount of players and groups, the playing surface of the game also allows for moves not possible in conventional chess, and the powers attained by few chess pieces adds more options for wins or saves.

SUMMARY OF THE INVENTION

This Summary is provided to introduce a selection of concepts in a simplified form that are further described below in the Detailed Description of the invention. This Summary is not intended to identify key aspects or essential aspects of the claimed subject matter. Moreover, this Summary is not intended for use as an aid in determining the scope of the claimed subject matter.

The present application discloses a unique chess variant with multitude of new play options and moves and the game can be played by several players on several chess boards wrapped around a rotating surface.

It is an object of the invention to provide a rotating surface comprising at least two 8×8 chess boards connected to each other wherein the first row of a first chess board connects to the first row of a second chess board and wrapped around the rotating surface wherein a column of the first chess board meets a column of the second chess board.

It is an additional object of the invention to provide a non-polyhedron or a polyhedron rotating surface whereby several chess boards are wrapped around it. The said rotating surface also provides the option to keep adding as many chess boards as desired by the players which further provides an opportunity for many players to play the game.

It is another object of the invention to provide a visual indicator or physical divider separating one chess board from another chess board when connected to each other and wrapped around the rotating surface. The indicator is marked and referred to as a dividing line for purposes of this present disclosure. The positioning of chess boards when wrapped around the rotating surface provides 16 chess pieces placed on each side of the dividing line separating the two chess boards.

It is a further object of the invention to provide multiple directional arrows on the last two columns of both sides of each chess board to communicate direction for the movement of designated chess pieces.

It is yet another object of this invention to provide at least two chess boards on the rotating surface wherein the game is played by at least two players on the first chess board and at least two players on the second chess board. However, the game can also be played by just two players wherein both players will play on both chess boards simultaneously. The chess-like game provides opportunity to form teams/alliances among the players provided there is at least one opponent player.

It is still another object of the invention to provide a variation of game wherein one of the pawn pieces with a distinguishing feature attains additional powers when the said pawn crosses the dividing line to move onto the next chess board. The said pawn remains hidden unless formally revealed by the player.

It is an additional object of the invention to provide one of the pawn pieces with additional powers which may include being elevated or crowned as a king, whereby the alliance on the next chess board attains multiple kings. Further, if the king of the alliance has been captured by the opponent player, the pawn which gets elevated to king when moves onto the next chess board provides another chance to the alliance to continue to remain in the game.

There is disclosed a method of arranging a chess-like game on a solid rotating surface comprising configuring at least two 8×8 chess boards to be connected to each other, back-to-back wherein the first and the last rows of the first chess board is aligned adjacent to the first and the last rows of the second chess board, respectively. The said chess boards are wrapped around the said rotating surface. It further comprises at least two dividing lines separating the two chess boards, wherein the first dividing line separates the first row of the first chess board and the first row of the second chess board, thereby aligning the same colored chess pieces on the first two rows of the first chess board and the second chess board, respectively, and wherein the second dividing line separates the last row of the first chess board and the last row of the second chess board, thereby aligning the another set of colored chess pieces on the last two rows of the first chess board and the second chess board, respectively.

The method further comprises arranging a first set of 16 chess pieces on first two rows of the first chess board on one side of the first dividing line; arranging a second set of 16 chess pieces on last two rows of the first chess board on one side of the second dividing line; arranging a third set 16 chess pieces on first two rows of the second chess board on the other side of the first dividing line; arranging a fourth set of 16 chess pieces on last two rows of the second chess board on the other side of the second dividing line. All the said chess pieces are secured onto each of the chess boards wrapped around the said rotating surface. The multiple directional arrows on either or both of the last two columns on both sides of the chess board are provided to communicate direction for the movement of the chess pieces.

There is also disclosed a method of playing the chess-like game on the rotating surface comprising arranging the chess-like game as disclosed above followed by each player taking turns to move at least one chess piece on every turn following the conventional rules of chess, such that each player tries to capture the king(s) of the opponent player. All the chess pieces may cross the dividing line to move onto the next chess board. One of the pawn pieces with a distinguishing feature attains additional powers when the said pawn piece reaches & crosses the dividing line to move onto the next chess board, wherein the said pawn remains hidden throughout the game unless formally revealed by the player. The additional powers of the said pawn further include being elevated or crowned as a king, whereby the alliance on the next chess board attains multiple kings provided the alliance has not lost its king. In addition, the player can transfer the elevated pawn as a king to its alliance whose king has been captured, thereby giving a second chance to the alliance to continue to play the game.

There is further disclosed a non-transitory computer-readable medium executing instructions from a data storage device and further executed by a processor to arrange a chess-like game on a rotating surface on a display unit comprising generating at least two 8×8 chess boards connected to each other, back-to-back wherein the first and the last row of the first chess board are aligned next to the first and the last row of the second chess board, respectively and the said chess boards are wrapped around the rotating surface. Further, the data storage device comprises a database which retains each team's or player's individual performance data information and results.

These together with other objects and advantages which will become subsequently apparent reside in the details of the invention as more fully described and claimed, reference being had to the accompanying drawings forming a part thereof, wherein like numerals refer to like parts throughout.

BRIEF DESCRIPTION OF THE DRAWINGS OF THE INVENTION

The novel features of the invention, as well as the invention itself, both as to its structure and its operation will be best understood from the accompanying drawings, taken in conjunction with the accompanying description, in which similar reference characters refer to similar parts, and in which:

FIG. 1: shows a perspective view of a chess ring wherein two chess boards are wrapped around the rotating surface with a view of the first chess board.

Figure 2:
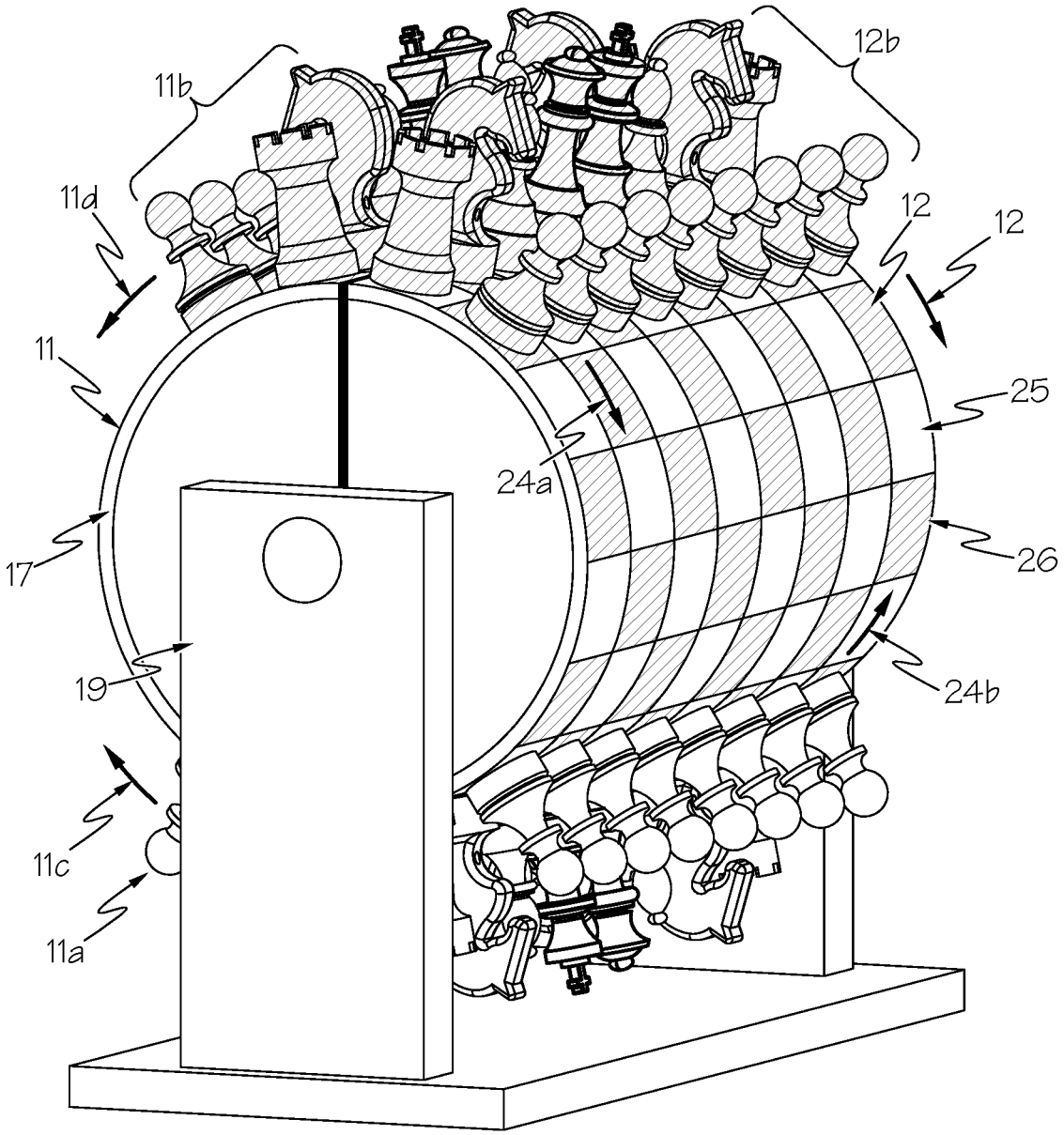

FIG. 2: shows a side perspective view of the chess ring wherein two chess boards are wrapped around the rotating surface with a view of the second chess board.

Figure 3:
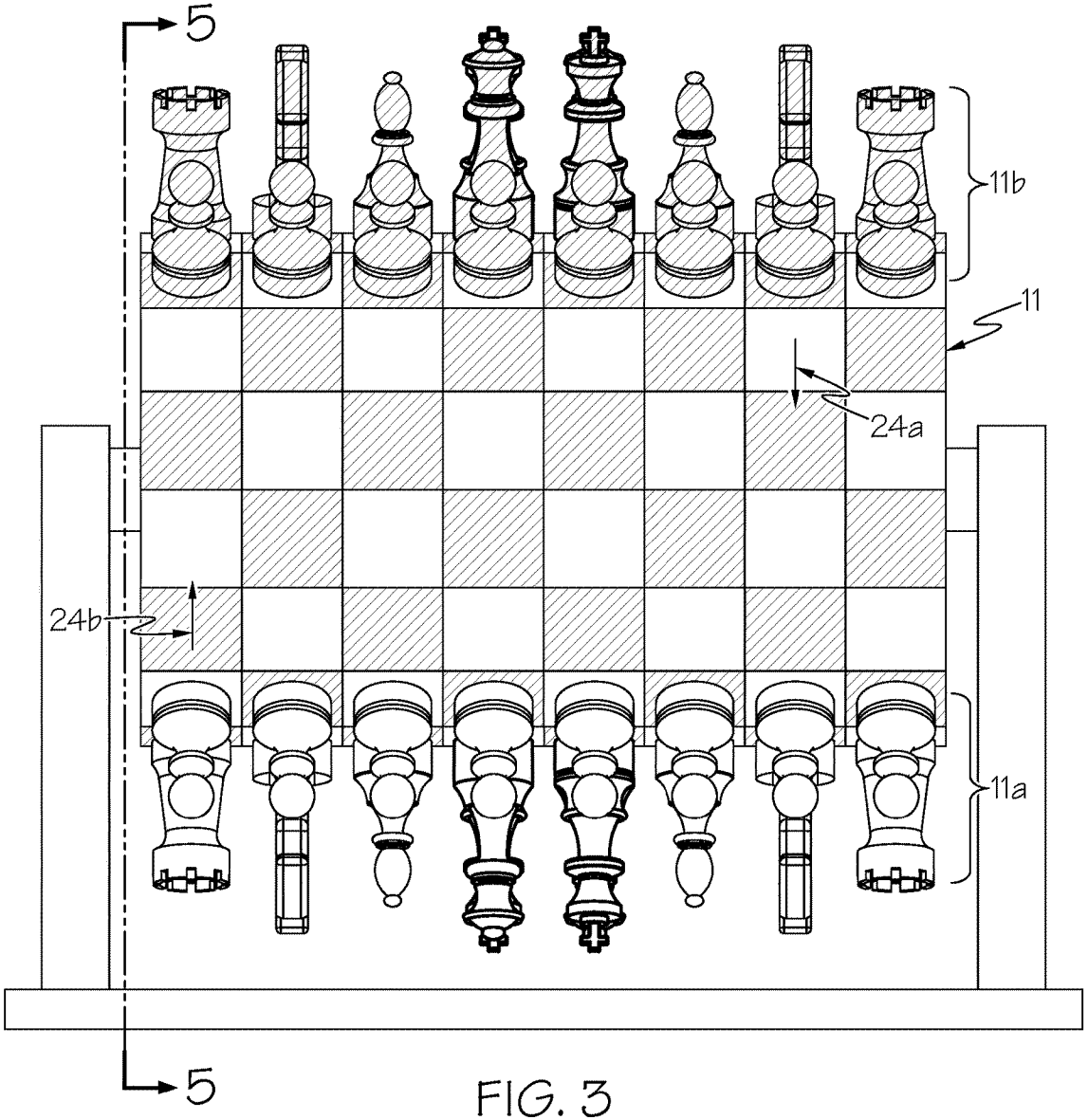

FIG. 3: shows exploding view of one chess board on the chess ring.

Figure 4:
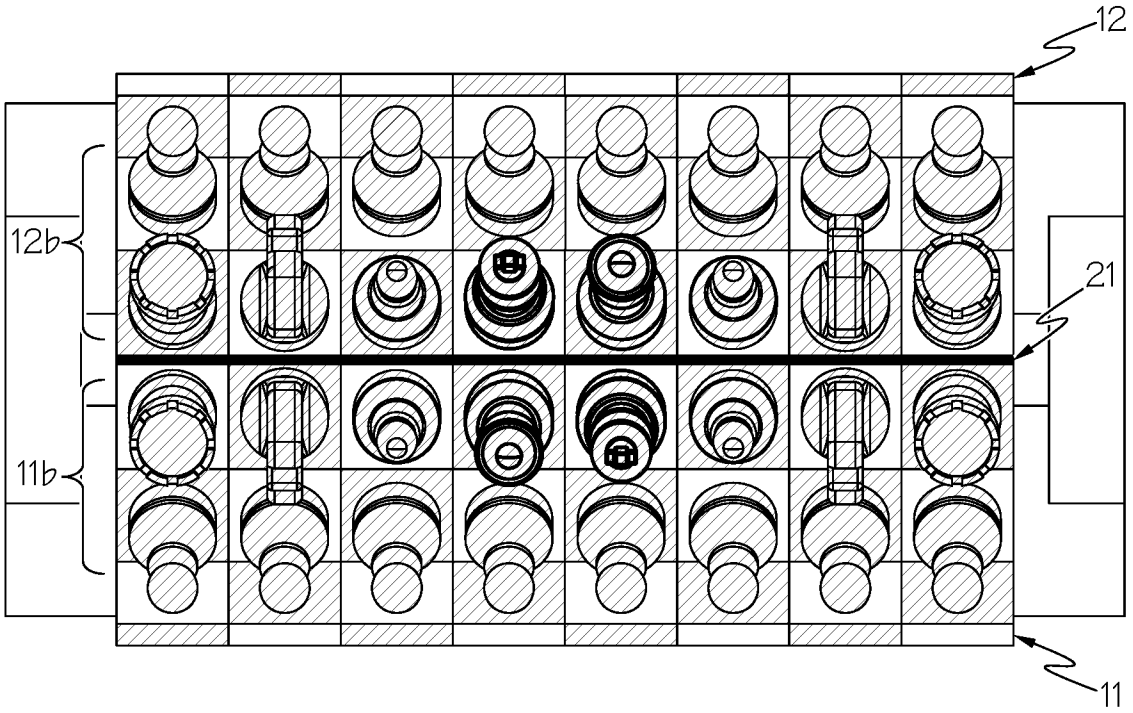

FIG. 4: shows a top view of the chess ring wherein two chess boards are wrapped around the rotating surface.

Figure 5:
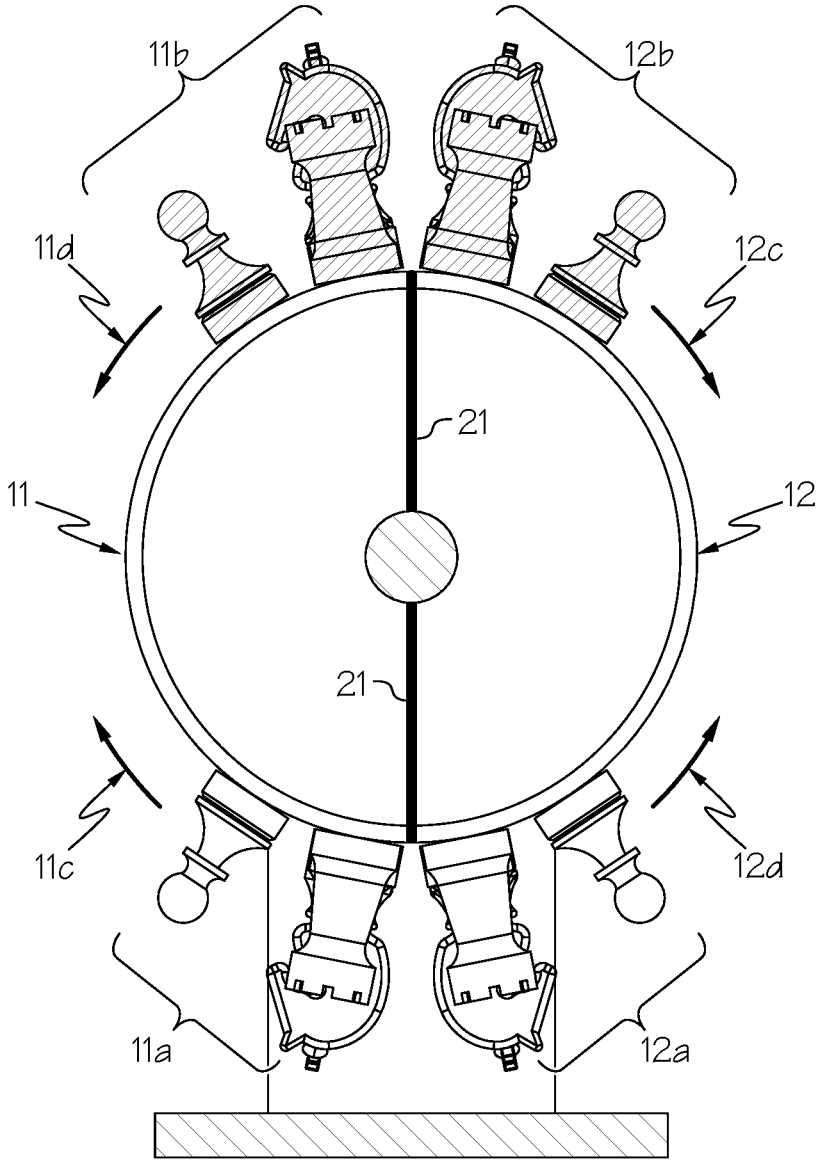

FIG. 5: shows a side view of dividing line or pole separating the two chess boards wrapped around the rotating surface.

Figure 6:
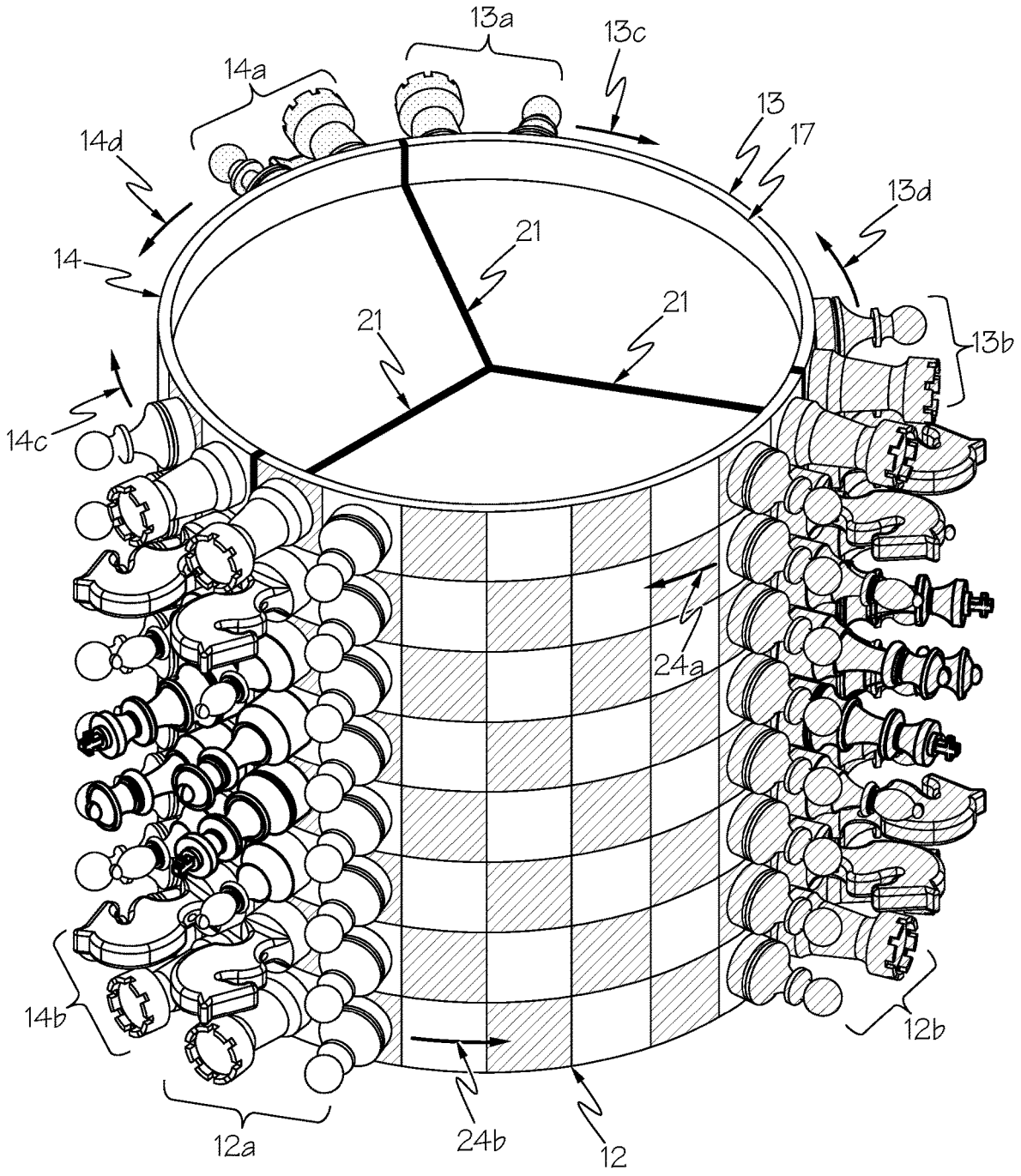

FIG. 6: shows a view of three chess boards wrapped on the rotating surface forming the playing surface.

Figure 7:
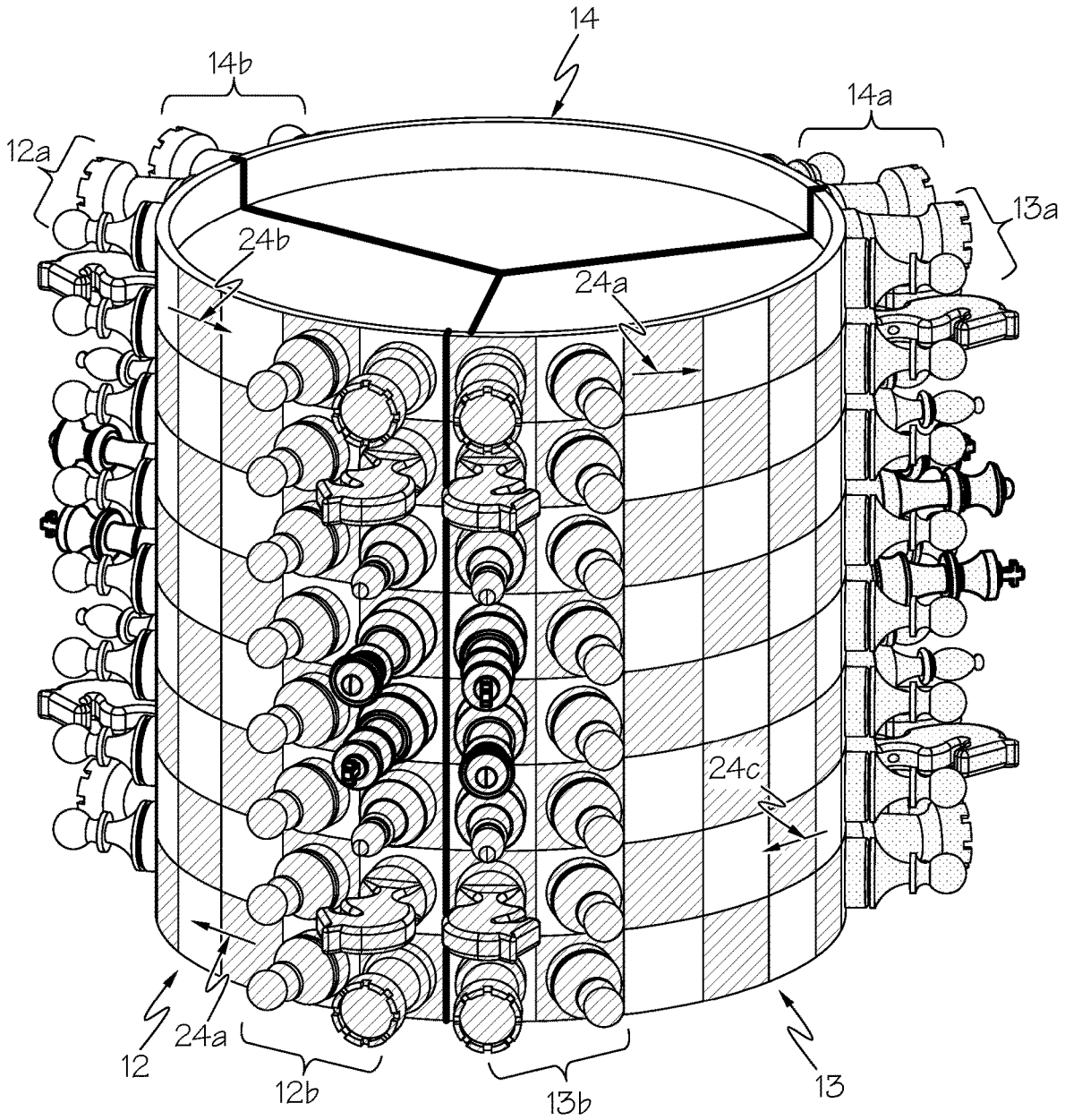

FIG. 7: illustrates another view of three chess boards wrapped around the rotating surface forming the playing surface.

Figure 8:
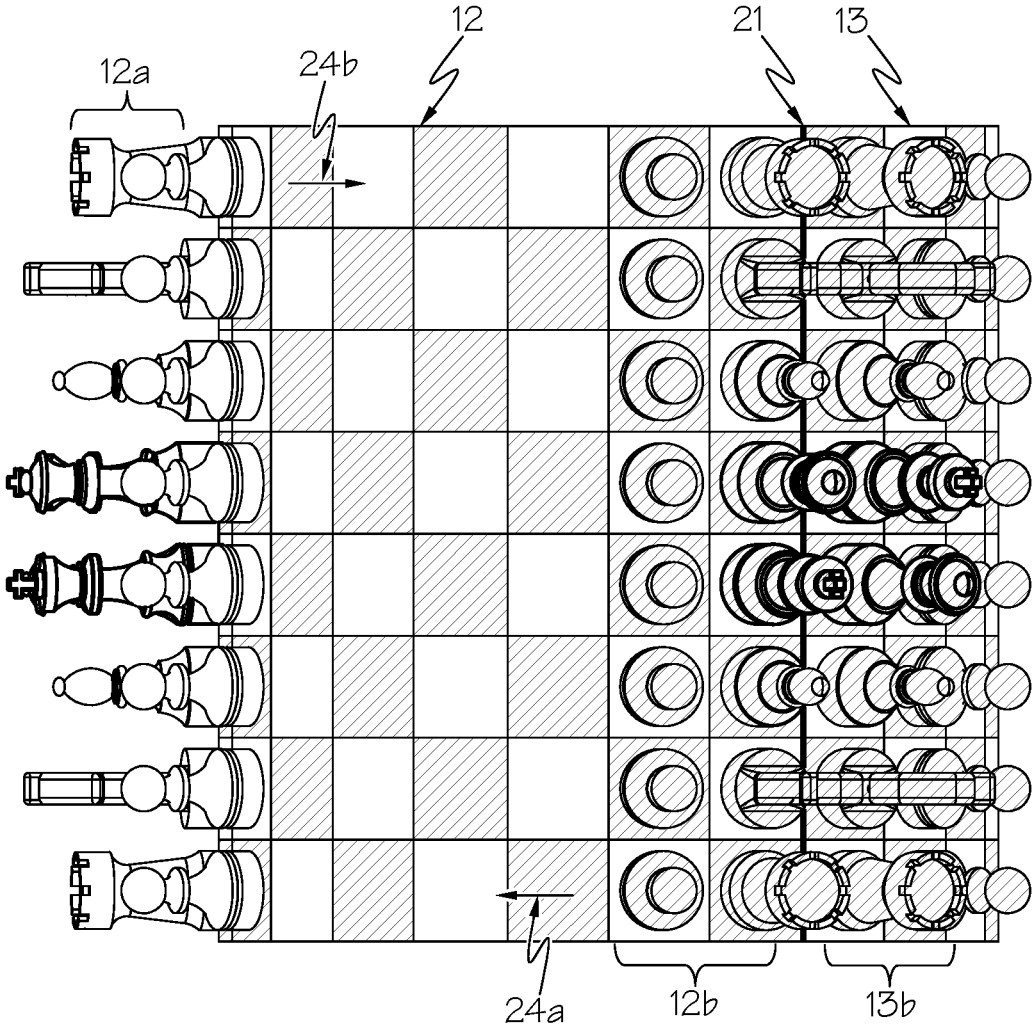

FIG. 8: shows top view of two chess boards displaying three sets of chess pieces.

Figure 9:
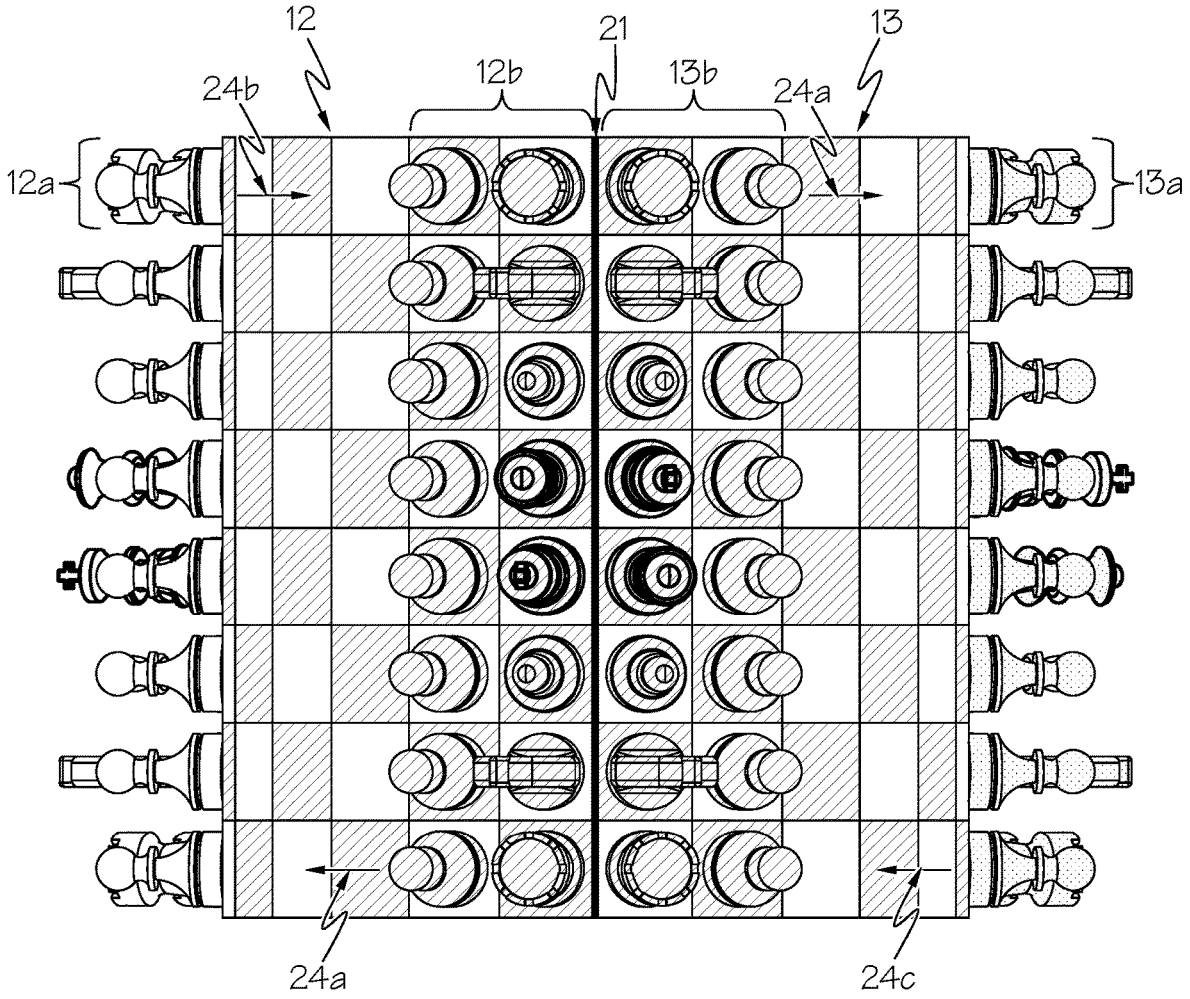

FIG. 9: illustrates top view of two chess boards displaying four sets of chess pieces.

Figure 10:
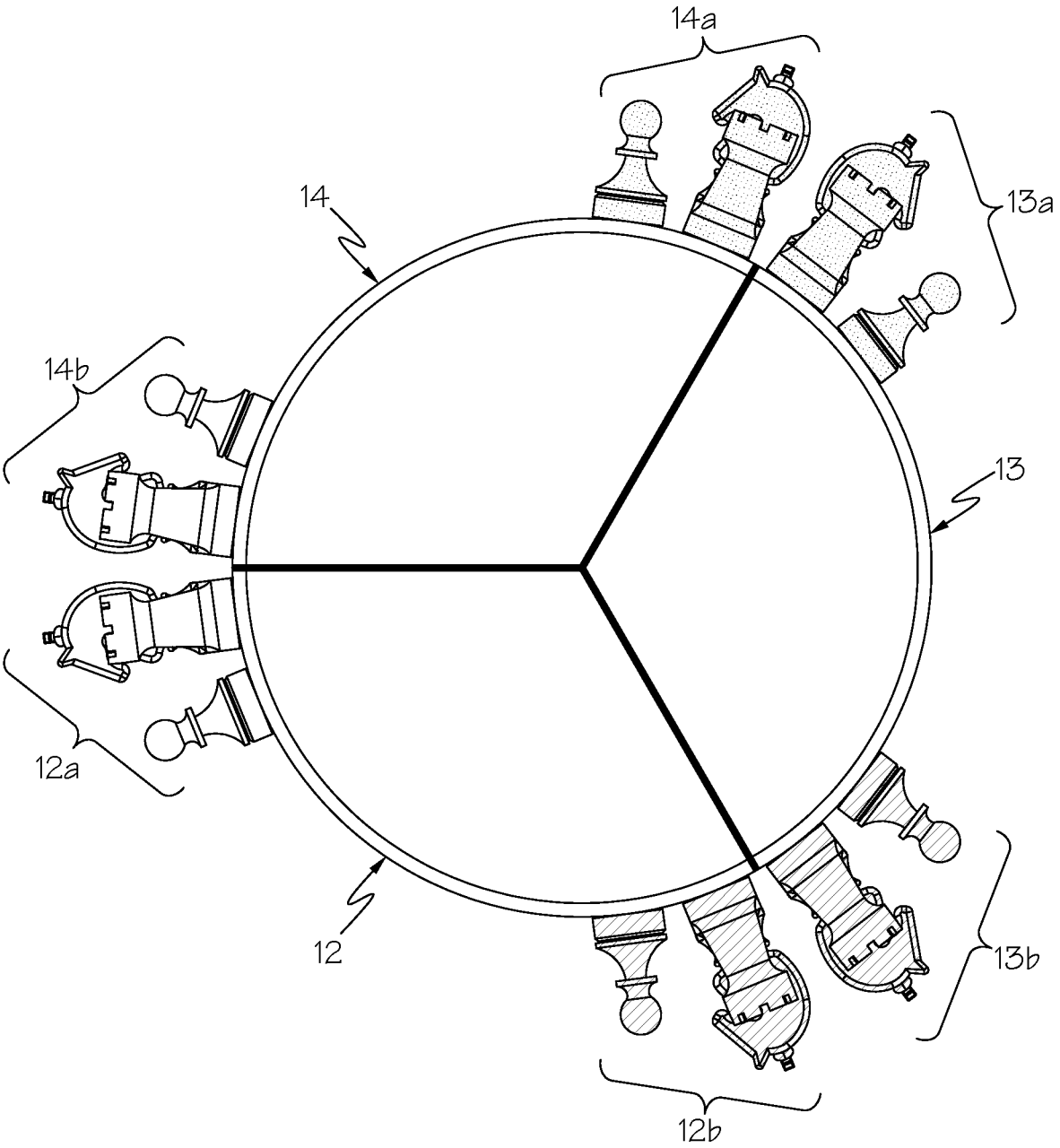

FIG. 10: illustrates a side view of three chess boards wrapped around the rotating surface.

Figure 11:
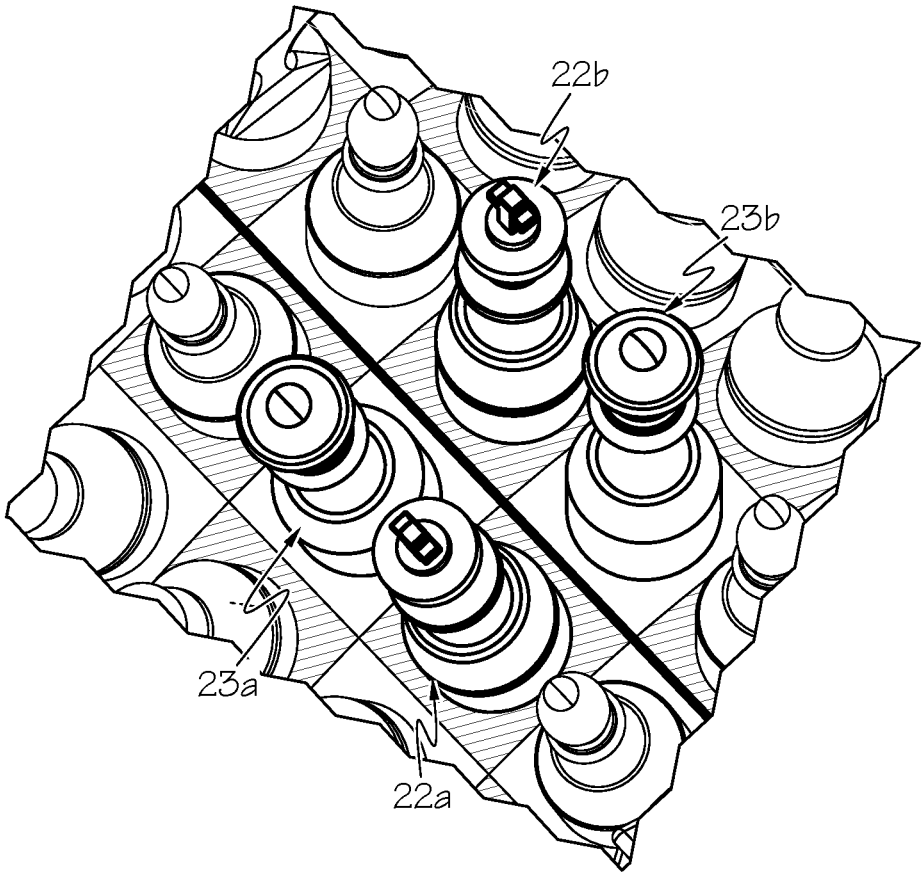

FIG. 11: illustrates a cutout view of a chess board showing king and queen pieces aligned diagonally on two chess boards across the dividing line.

Figure 12:
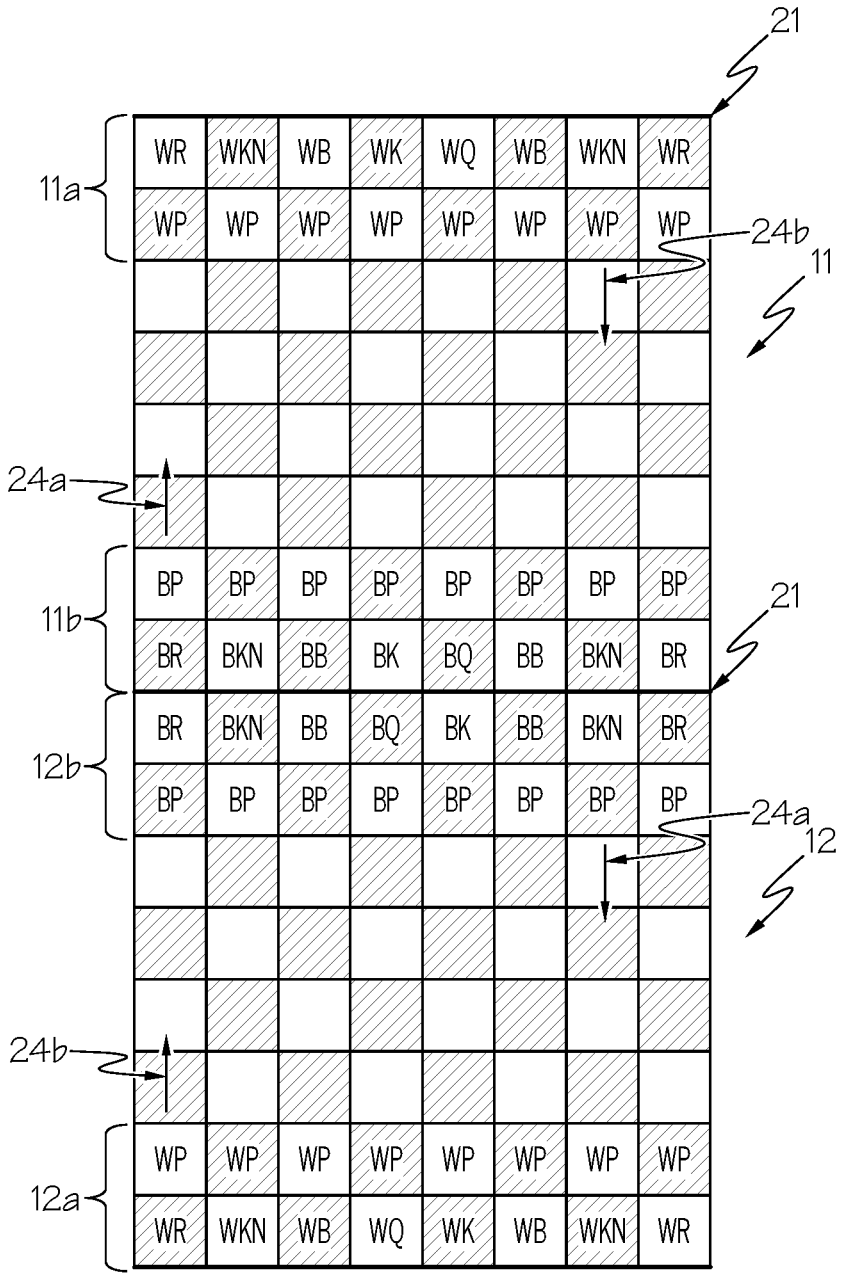

FIG. 12: illustrates a top view of two chess boards laid flat with dividing line separating the two chess boards.

Figure 13:
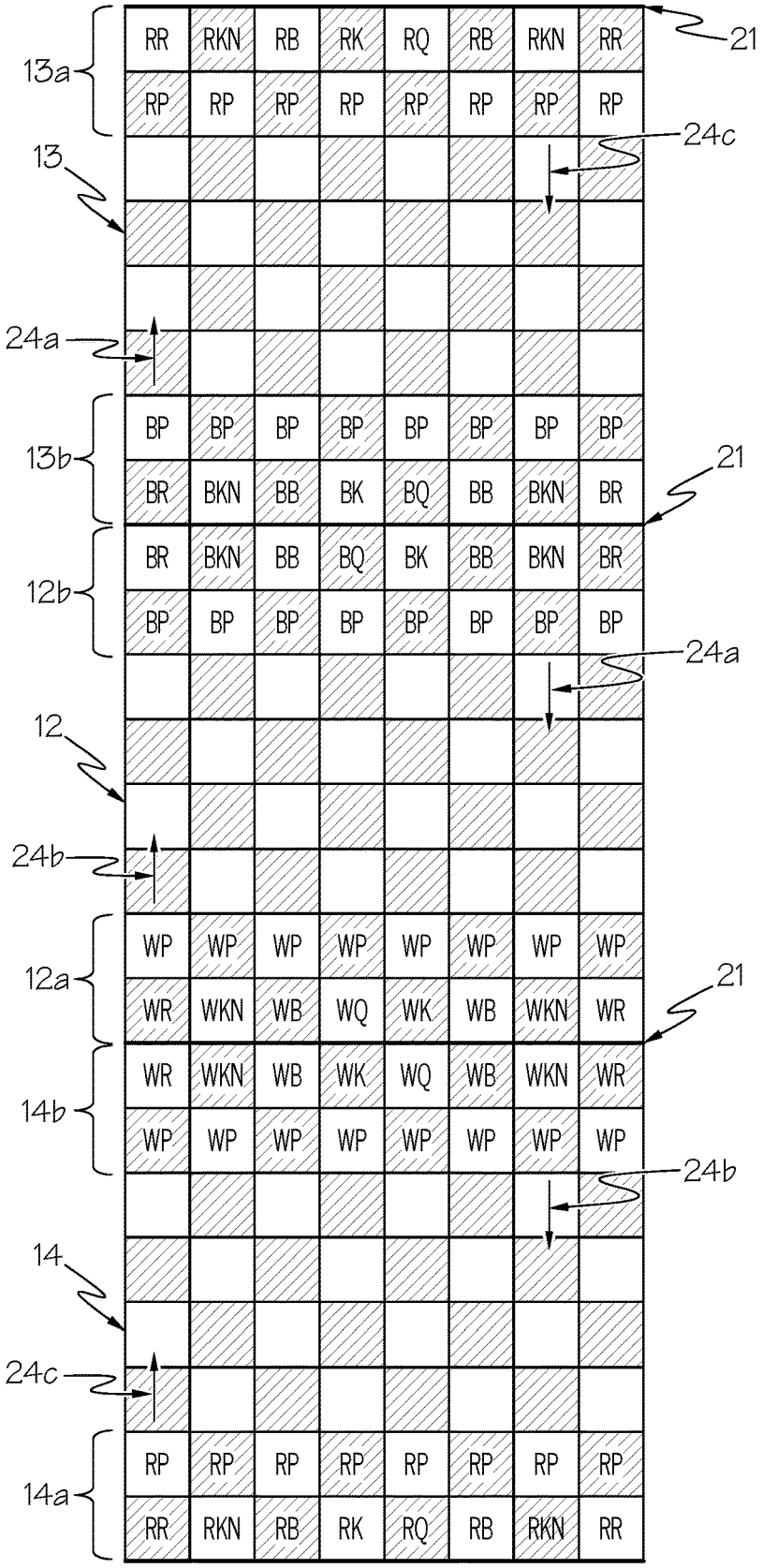

FIG. 13: illustrates a top view of three chess boards laid flat with dividing line separating the three chess boards.

DETAILED DESCRIPTION OF THE INVENTION

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skill in the art without departing from the scope of the invention.

The modified game disclosed in the present invention is played on conventional chess boards measuring 8 by 8 squares wrapped back-to-back around a rotating solid surface. The squares on the chess board alternate between light and dark colors. In a conventional chess board, there are eight columns and eight rows. The chess boards of the present invention have eight columns but multiple rows depending on the number of chess boards connected with each other and wrapped back-to-back around the rotating surface. The multiple rows of the chess boards wrapped around the rotating surface are divisible by eight. Every chess board will have chess pieces arranged on the first and the last two rows of each of the chess board.

The rotating solid surface onto which chess boards are wrapped around can be a polyhedron or a non-polyhedron solid surface. The polyhedron solid surface may include, but is not limited to, a pentagonal or hexagonal prism. Whereas a non-polyhedron solid surface may include, but not limited to, a circular ring or cylinder or a barrel or a tube. As shown in FIGS. 1-5, the chess model 10 comprises a solid rotating surface 17 which is mounted on a cylindrical beam or a rod 18 which in turn is affixed on two rectangular pillars 19 on each side of the solid rotating surface 17. The rectangular pillars 19 attached onto a base 20 and the cylindrical beam 18 attached to the rectangular pillars allows the rotation of the chess boards wrapped around the rotating surface, thereby allowing each player to rotate the chess boards and move the chess pieces to play the game. The rotating solid surface 17 is also referred to as a "chess ring" or a "ring" for the purposes of this disclosure.

The number of chess boards are wrapped back-to-back around the chess ring in such a way that the rows of at least two chess boards are parallel to each other, as shown in FIG. 1. The chess-like game of the present invention which is played on a rotating surface 17 provides the opportunity to wrap a multitude of chess boards around the rotating surface 17 thereby providing an opportunity for multitudes of players to play the said game. Therefore, there can be odd or even numbers of chess boards, as shown in FIGS. 1 & 6, wrapped around the rotating surface 17. However, the minimum number of chess boards that can be wrapped around the rotating surface 17 is at least two and with no necessary impediment on maximum number of chess board. The players can choose to play with as many chess boards as desired. For example, the players or teams can decide to play the game on up to five hundred chess boards. The chess boards are attached simultaneously to each other, back-to-back, wherein the first and the last row of the first chess board is aligned adjacent to the first and the last row of the bordering second chess board. The same pattern is followed for adding more chess boards wherein the last row of the last chess board is aligned adjacent to the first row of the bordering new chess board, and the last row of the new added chess board is aligned adjacent to the first row of the first chess board. The said chess boards are wrapped around the rotating surface 17 wherein the game is played by at least two players. Therefore, the number of boards may range from, but not limited to, 2-100 thereby allowing anywhere from, but not limited to, 2-200 alliances and/or players to play the game. The game is played by at least two players on a first chess board 11 and two players on a second chess board 12. The variation described herein also lets two players play on the first chess board 11 and the second chess board 12 simultaneously.

Prior to the commencement of the play, the chess boards, once wrapped around the rotating surface, are set up according to the conventional rules of chess wherein the chess pieces are positioned in the first, second, seventh, and eighth horizontal rows of each chess board. The two colors of chess pieces on each chess board include 1 king, 1 queen, 2 bishops, 2 knights, 2 rooks, and 8 pawns on both ends of each chess board. Each player has 16 pieces and each piece moves in a specific manner according to the conventional rules of chess unless mentioned differently. The first two rows of a chess board are set up with white/lighter pieces, and the last two rows are set up with black/darker pieces.

The rotating solid surface 17 has a divider or indicator separating each chess board. The said divider or indicator may include a thin steel or rubber pole dividing the chess boards. It may further include a thick line drawn between the chess boards or a strip made of paper or any material glued between the chess boards indicating where one chess board ends and the next chess board starts. The thick line can be black or any color as aesthetically desired. The said divider may feature at least one of an optical, acoustic, tactile, haptic, visual, or electrical feedback to enhance the playing experience of the game. Optical features may include an illumination of light that comprising of a change in brightness, intensity, or luminance. For purposes of this present disclosure, a dividing line 21 is drawn in black color and is illustrated in FIGS. 4 & 5. As shown in FIG. 4, the dividing line 21 is present in the middle of a set of chess pieces 11*b* on the chess board 11 and a set of chess pieces 12*b* on the chess board 12 and thereby separating the chess board 11 from the chess board 12. Therefore, the dividing line 21 will be present between each pair of chess boards thereby separating one chess board from another chess board. A player may move all the chess pieces across the dividing line 21 to move onto the next chess board to assist their ally.

On each side of the dividing line 21, conventional chess pieces are set up according to the conventional chess rules, wherein the said chess pieces on each side of the dividing line 21 are of the same color or any dark color or any light color. For example, in the case of two chess boards wrapped around the rotating surface 17, as shown in FIG. 5, the first set of white chess pieces 11*a* on the chess board 11 will be adjacent to the second set of white chess pieces 12*a* on the chess board 12 and, on the opposite side, the first set of black chess pieces 11*b* on the chess board 11 will be adjacent to the second set of black chess pieces 12*b* on the chess board 12, respectively.

In a case, where traditional black/white pieces are not desired, alternative color combinations may be utilized. However, alliances must be made among the players before starting the game when playing with different color combinations. For example, where a player has chosen dark/light chess pieces like red/cream and gold/silver chess pieces, cream and silver chess pieces will be placed adjacent to one dividing line and red and gold chess pieces will be placed adjacent to the next dividing line. In the case of an odd number of chess boards, at least two sets of chess pieces on the two rows of the third chess board and adjacent to each other will be a color different from the other sets of chess pieces. As shown in FIGS. 6, 7 & 10, the chess board 14 has white (14*b*) and red (14*a*) set of chess pieces, the chess board 12 has black (12*b*) and white (12*a*) set of chess pieces, the chess board 13 has black (13*b*) and red (13*a*) set of chess pieces, wherein red/red, black/black, and white/white chess pieces are adjacent to each other.

The chess board of the present invention is further provided with multiple directional arrows on each chess board to communicate direction for the movement of designated chess pieces. In FIG. 3, on one side of the chess ring, on the chess board 11, directional arrows 24*a* indicate the directional movement for the black chess pieces 11*b*, whereas direction arrow 24*b* on the opposite side indicate the directional movement for the white chess pieces 11*a*. In one aspect, the said directional arrows are of the same color as the chess pieces designated with respect to the said directional arrow in order to avoid confusion for the players. For instance, in FIG. 7, the direction arrow 24*c* can be of red color for the red chess pieces 13*a*, the direction arrow 24*a* can be of black for the black chess pieces 13*b* & 12*b* and similarly the direction arrow 24*a* can be of white color for the white chess pieces 12*a* & 14*b*. When multiple colored chess pieces are used, the said directional arrows will be assigned a corresponding color of the chess pieces that are designated to follow the directional arrow. In another aspect, the directional arrows help in setting up the chess ring properly wherein the player/alliance playing the black chess pieces will face the ring so that the black arrows 24*a* are on the right side and the player/alliance playing the white chess pieces will be facing the ring so that the white arrows 24*b* are on the right side of the ring, as can be seen in FIGS. 2 & 6.

There is also provided means to secure all of the chess pieces onto each of the chess boards wrapped around the chess ring. In one aspect, the chess pieces may be attached to the chess board via Velcro™ or any alternative type of fasteners or securing mechanism. In another aspect, the chess pieces may be attached via magnetic material, wherein the chess boards are made up of metallic material (e.g. steel).

The chess pieces are positioned in the two rows closest to the dividing line 21 separating the many chess boards. The second row—i.e. the second row from the dividing line 21, consists of a line of 8 pawns each placed on a single square of the chess board. The first row is arranged as in a conventional chess game, wherein rooks/castles are placed on the two corner squares on the left and right end of the chess board, followed by knights on the next squares, and then bishops. The king and queen are placed on the two central squares of the row. The queen is always placed on the square matching her color or the light-colored queen on the lightest colored square and the dark colored queen on the dark colored square with the king occupying the remaining square of the opposite color. In a conventional chess board, the king and queen of each color face each other, making the correct setup symmetrical between the players/alliances. In the modified game, the queen and king chess pieces of the same color will be diagonal from each other and back-to-back across the dividing lines as can be seen in FIGS. 8 & 9. FIG. 11 shows queen chess pieces 22*a*& 22*b* and king chess pieces 23*a*& 23*b* diagonal to each other. Similarly, in FIG. 12, which shows two chess board laid flat and connected to each other shows black king (BK) & black queen (BQ) from 11*b* & 12*b* set of chess pieces are diagonal to each other whereas they face white king (WK) & white queen (WQ) from set pieces 11*a*& 12*a*. However, in a variation of the game, where an odd number of chess boards are present, few chess boards may have a king and a queen placed in parallel to each other and back-to-back across the dividing lines. FIG. 13 shows 3 chess boards 13, 12 & 14 laid flat and connected end-to-end wherein the two chess boards 13 & 14 have both red king (RK) and red queen (RQ) from 14*a* and 13*a* parallel and back-to-back to each other across the dividing line 21.

Further, since the rotating surface 17 is on the cylindrical beam 18, it can either move clockwise or anti-clockwise as desired by the player/team. In case of two chess boards 11 & 12 wrapped around the rotating surface 17, as shown in FIG. 5, a player can move the chess board 11 clockwise 25*a* or anticlockwise 25*b* whereas the chess board 12 can be moved clockwise 26*a* or anticlockwise 26*b* to enable players to move the chess pieces or just see where the chess pieces are set. FIG. 6 shows three chess boards 12, 13, & 14 wrapped around rotating surface 17. The chess boards 13 and 14 can be moved into clockwise directions, 27*a* & 28*a*, and anticlockwise directions, 27*b* and 28*b*, respectively.

The chess-like game of the present invention provides the opportunity to players to attain multiple kings on the same or different chess boards. It further provides an opportunity to assist their allies if they have lost a king. The players can attain multiple kings by promoting one of the pawns, which is provided with additional powers not present in conventional chess pieces, when it passes the dividing line and moves onto the other chess board. The said pawn remains concealed within the rows of the pawns and is placed secretly in any of the 8 squares in the second row on each chess board among the pawns. The said pawn looks no different than any of the other regular pawns with one distinguished feature not visible to the opponent. In one aspect, the distinguishing feature is mostly provided at the bottom to make it possible to remain concealed and does not get attacked by the opponents. The said distinguishing feature can be a dot on the bottom of the chess piece. The said conventional chess piece/pawn with distinguishing feature is referred to as "prince" for purposes of the present disclosure. The white chess piece can be marked with a black dot on the bottom and the black chess piece can be marked with a white dot on the bottom. When more than two colors and groups are playing, the chess piece can be marked with a dot on the bottom that is a different color. In another aspect, the distinguishing feature includes at least one of an acoustic, optical, tactile, haptic, electrical, or visual features when revealed formally as a prince to the opponent. Optical features may include an illumination of light comprising of a change in brightness, intensity, or luminance.

The prince must move like a pawn when moving on the first chess board. The prince can remain concealed within the rows of the pawns throughout the game unless the player chooses to reveal and elevate it to a king. The prince can become a king (or be crowned) by moving not only all the way across its chess board but by reaching the opposite chess board after crossing the dividing line. For example, the white prince on the chess board 11 moves all the way across the chess board 12 and then crosses the dividing line 21 dividing the chess boards 11 & 12 to move onto the chess board 12. The chess board 12 now has two white kings. In addition, the player can convert the hidden prince to king level, if the original king has been captured by the opponent, provided the prince has crossed the dividing line to move onto the next chess board. However, if the prince gets captured, the said player loses the opportunity to convert it to a king. If the prince is in check/checkmate, if that pawn can cross the dividing line in the next move, then only it can be elevated.

In one aspect, there is provided a variation wherein a player can have more than one prince if all the players playing the said game agree. It is up to the creativity of players playing the game and how complex they wish to make the game. However, only a chess piece with a distinguishing feature, like a dot on the bottom, can be elevated when the said chess piece has crossed the dividing line to move onto the next chess board.

In more than two players game, the player's ally would get another king since the elevated prince has moved on that player's chess board. The players are provided with options to either change pieces on the chess board where one king has already been captured and get the said king back on the chess board in place of the prince when the said prince is elevated to king level or a player can clip a crown onto the prince when converted to king.

However, the prince cannot be crowned or elevated if the crowning move would put the new king in check. In addition, the prince cannot be crowned after a last standing king has been put in checkmate unless done by the ally of the player put in check on their ally's very next move.

In this modified chess-like game, each player and group takes turns to make a single move. The players cannot choose to skip a turn unless the player has no available moves then that player's move is forfeited and the next player gets to make a move. Also, moving any chess pieces fully around the chess ring back to their original positions is illegal. For example, a queen or a rook cannot move all the way around the chess board barrel into its original place in that column. Each chess piece moves in a specific way, and must be moved according to its legal movement. In a 2 player game, the white player takes the first move, with players alternating single turns until a player is defeated via a captured king or resignation. In a 4 player game, the white player on the chess board 11 moves 1st then the black player on the chess board 11 moves 2nd followed by the white player on the chess board 12 and then the black player on the chess board 12. On a chess ring, where an infinite chess boards are wrapped around the rotating surface, this sequence of moves will be followed. The players and the groups keep playing until the opposing group is defeated via a capture of their last standing king or resignation or a draw is determined.

In the case of two players playing on two chess boards, it is played similar to traditional chess with a modification, wherein the players can move any chess piece of the color they are playing onto either the chess board 11 or the chess board 12 and vice versa.

When three or more players are involved, alliances are made. The players must choose a color and a chess board to play on. When there are three players, two players may have an alliance against one player who will have two turns moving their color (the single player must play chess pieces of the same color) and will have the advantage of moving any of their chess pieces on either chess boards 11 or 12 on any given move. The two players who are allied will have to wait three moves before making a move on only their chess boards. In a case of infinite chess boards on a chess ring, with an odd number of players, a single player may play on two separate chess boards in this same manner.

The pawns can move one space forward in the directional movement, unless players choose to move the pawn forward two spaces on that pawn's first move, indicated on that chess board. A player can capture an opponent's chess piece if a piece lands on a square with an opponent's piece, and that piece is removed from the chess board. As in a regular game, the chess pieces cannot be placed on the same square as a chess piece of the same color. When a chess piece captures an opponent's chess piece, it must finish its current move action to end the player's turn.

In a conventional chess game, when a player's king is captured, the opponent wins the game. However, in this game, even if a player's king has been captured, the player can continue to play and assist his alliance protecting their king. In addition, a player may pass their ally, whose king has been captured, a prince, thereby promoting that prince to a king, thereby giving that ally/player a second chance. However, if the prince has not crossed the dividing line and is yet to reach the other chess board, the player cannot assist his ally, whose king has been captured, as the said prince cannot be passed to the ally. In the end, the game is won by a player or group who has a king standing. A draw can also be agreed. If playing with an optional timer, as in tournaments, the first player/group to run out of time, forfeits the game.

In a game, where there are odd numbers of players playing the game and the prince after crossing the dividing line reaches the opponent's territory, wherein there are no allies on that chess board, the said player has the option of moving its prince back onto its chess board.

When a piece is moved so that it is able to take the king on its next move that means the king is in check and the player/group that has the king in check must announce the check. Not announcing a check when the opponent(s) is in check is illegal and the penalty is a pawn move by the player whose move placed their opponent in check. The said player has the option of moving the prince during the penalty move. If that said player does not have a pawn or a prince to move, that said player's move is forfeited for that particular penalty move. The rules for the prince apply even when moving the prince in this penalty move. If the prince is alone with no other pawn able to move and the move would put the prince in check, then that said player's move is forfeited. Alternatively, that said player could choose to reveal the remaining pawn is a prince as a penalty move.

The goal of playing this chess-like game of the present invention is to capture all of the possible kings unless all of the opponent's multiple kings on the chess ring can be put in checkmate with a single move. A player/group wins the game when the last king of the opponent(s) is captured. Unlike the conventional chess, in a multiple player game of the present invention, even when a player loses their king they will continue playing kingless until the game is won, drawn, or forfeited. This means that the player who has lost their king can continue to play the game and assist their allies in capturing the king of their opponent until all of their allies' kings have been captured or have surrendered.

When a player/group has all the kings in check, that player can choose to not move any king out of check. When one of the player's kings are in check while multiple kings are in the ring the game can proceed as if the king is one of the other pieces. The attacker can take the king or leave it, the defender can make a move so that the king is not in check or leave it in check while there are multiple kings for that player/group. However, if moving a king would put king of your allies or any of their own kings in check, your king must stay in check.

The player/group whose last king standing is placed into check must move their last king or move another piece to stop the attack on their next turn—either by blocking the move or capturing the attacking piece.

If a player/group creates a situation where their opponent cannot stop their last king from being captured on their next turn, the attacking player/group may announce "checkmate" as an alternative to check. Checkmate occurs when a player/group cannot escape check on the last king, meaning their last king would be captured on its next turn. Even after a checkmate is announced the rest of the players must continue moving until the last king in checkmate is taken or surrenders leaving that group/player with no king. When the player/group whose last king has been checkmated loses that king, the game ends unless their alliance has crowned a prince on their next move (which is the only time a prince can be crowned after a checkmate has been announced) or their opponent chooses not to take their last standing king. The last king preferably should never be captured but the player/group should forfeit the game before capture and retain points.

A player/group can also choose to resign, granting their opponent the victory. The games can also end in an agreed draw, for example, as the result of stalemate leaving a player/group without any legal moves, or if no player can win using available legal moves, a situation known as a "dead position". One example of a dead position is when both the players/groups are left with their last king as their only remaining piece on the chess board.

In another aspect of the invention, the new chess board and the method of playing as disclosed in this disclosure can be generated on a computing device with computer executable instructions wherein a multitude of chess boards can be wrapped around the rotating surface. There is no limit to the amount of players as one can continue putting the chess boards back-to-back around an infinitely expanding chess ring. Many different colors of chess pieces could be used making up many different groups or alliances among the players. In addition, the players can play with each other wherein each player can be in a different location playing on their personal computing device, form multiple groups or alliances with each other to play against other groups or a player can play against the computer.

An electronic game incorporating the modified chess game as described herein can be played on any personal electronic device like desktop, laptops, tablets, smartphones, hand-held devices, or game consoles. Further, the electronic game could be played in a Web-based, browser-based, or cloud-based environment. A computing system including an Operating System (OS), a Central Processing Unit (CPU) or a main processor or a microprocessor and a non-transitory computer-readable medium is provided to play the video game described herein. There is also a data storage device or a hard disk drive (HDD) or solid state drive (SSD) provided which will include the program or code or computer executable instructions on how to add/delete the chess boards, how to play the modified chess game, what moves are allowed or not allowed, when a game is stalled or won/lost by the player(s). The said instructions will also include ways to rotate the chess boards as many times to let players see each chess board.

The said data storage device may further comprise a database which retains each player's individual performance data information and results, such as their ranks, points, rewards, prizes, or trophies earned. In addition, the database may retain each team's or individual's data information and results, such as, but not limited to, their combined ranks, points, rewards, prizes, or trophies earned. The said processor receives and executes instructions received from a memory unit that includes a computer readable medium to perform the operations stored therein.

The computer executable instructions when read by the memory unit and then run by the processor generates a conventional chess board on the display unit of the computing device to be played by players logged in. The said instructions will include all the conventional chess moves as well as the modifications discussed and claimed herein to allow players to play the said chess game. The instructions can include arranging a chess-like game on a solid rotating surface on a display unit of a computing device comprising generating at least two 8×8 chess boards connected to each other, back-to-back wherein the first and the last row of a first chess board meets the first and the last row of a bordering second chess board, respectively, with the said two chess boards are wrapped around the said rotating surface. At least two dividing lines indicating where a first dividing line separates the first row of the first chess board and the first row of the second chess board, thereby aligning the chess pieces, of first color, on the first two rows of the first chess board and the second chess board, respectively, and wherein a second dividing line separates the last row of the first chess board and the last row of the second chess board thereby aligning chess pieces, of second color, on the last two rows of the first chess board and the second chess board, respectively.

The instructions further include arranging a first set of 16 chess pieces on the first two rows of the first chess board on one side of the first dividing line, followed by arranging a second set of 16 chess pieces on the last two rows of the first chess board on one side of the second dividing line, then arranging a third set 16 chess pieces on the first two rows of the second chess board on one side of the first dividing, and lastly, arranging a fourth set of 16 chess pieces on the last two rows of the second chess board on one side of the second dividing line. Each set of 16 chess pieces on each of the chess boards include 1 queen, 1 king, 2 knights, 2 bishops, 2 rooks, & 8 pawns. The chess boards may display multiple directional arrows on the last two columns on both sides of the chess board to communicate direction for the movement of the designated chess pieces. In one aspect, the players may choose the colors of the said directional arrows corresponding to the color of their designated chess pieces or may choose a different color if desired.

In one aspect of the invention, the dividing line features at least one of an illuminating, acoustic, tactile, haptic, visual, or electrical feedback to enhance the playing experience of the game.

In another aspect of the invention, a player may choose different levels when playing the game online. For example, a player can choose from level 1 to level 10, wherein levels 1-3 being easy/beginner level, levels 4-7 being moderate level and levels 8-10 being expert/grandmaster level.

In another aspect of the invention, the chess boards are wrapped inside as well as outside the rotating solid surface thereby increasing the number of chess boards and the number of players by twofold. The conventional chess pieces are placed on the inside chess boards and outside chess boards of the rotating surface. Therefore, the typical two chessboard and a four player ring could be turned into a four chess board and an eight player game with two chess boards on the outside of the rotating surface and two chess boards on the inside of the rotating surface. The chess ring with three chess boards wrapped around the rotating surface could then become up to a twelve player game with three chess boards on the outside diameter and three chess boards on the inside diameter.

While many of the fundamental characteristics and features of the modified chess game have been described herein, with reference to particular embodiments thereof, a latitude of modification, various changes and substitutions are intended in the foregoing disclosure, and it should be apparent that in some instances some features of the invention will be employed without a corresponding use of other features without departing from the scope of the invention as set forth. It should be understood that such substitutions, modifications, and variations may be made by those skilled in the art without departing from the spirit and scope of the invention. Consequently, all such modifications and variations are included within the scope of the invention as defined herein.

The invention claimed is:

1. A method of arranging a chess-like game, prior to the commencement of play, on a physical rotating surface comprising:

configuring at least two 8×8 chess boards to be connected to each other, back-to-back, wherein the first and the last row of a first chess board is aligned adjacent to the first and the last row of a bordering second chess board, respectively, with the said at least two 8×8 chess boards wrapped around the said physical rotating surface;

providing at least two dividing lines indicating where a first dividing line separates the first row of the first chess board and the first row of the second chess board, thereby aligning the chess pieces, of a first color, on the first two rows of the first chess board and the second chess board, respectively, and wherein a second dividing line separates the last row of the first chess board and the last row of the second chess board thereby aligning the chess pieces, of a second color, on the last two rows of the first chess board and the second chess board, respectively;

arranging a first set of 16 chess pieces on the first two rows of the first chess board on one side of the first dividing line;

arranging a second set of 16 chess pieces on the last two rows of the first chess board on one side of the second dividing line;

arranging a third set of 16 chess pieces on the first two rows of the second chess board on one side of the first dividing line;

arranging a fourth set of 16 chess pieces on the last two rows of the second chess board on one side of the second dividing line;

securing all of the chess pieces onto each of the chess boards wrapped around the said physical rotating surface; and providing multiple directional arrows on the last two columns of both sides of each chess board to communicate direction for the movement of the designated chess pieces.

2. The method of claim 1, wherein the said physical rotating surface is a non-polyhedron or a polyhedron surface.

3. The method of claim 2, wherein the said physical rotating surface is a circular ring, cylinder, barrel, or tube.

4. The method of claim 2, wherein the said physical rotating surface is a pentagonal or hexagonal prism.

5. The method of claim 1, wherein the number of chess boards wrapped around the said physical rotating surface is an odd number greater than 2.

6. The method of claim 1, wherein the number of chess boards wrapped around the said physical rotating surface is an even number equal to or greater than 2.

7. The method of claim 1, wherein the king and queen chess pieces of the first and the second color align diagonally to each other.

8. The method of claim 1, wherein the king and queen chess pieces are parallel to each other on at least one board if the number of chess boards are odd in number.

9. The method of claim 1, wherein the dividing line further features at least one of an optical, acoustic, tactile, haptic, visual, or electrical feedback to enhance the playing experience of the game.

10. A method of playing chess-like game on a physical rotating surface comprising:

configuring at least two 8×8 chess boards to be connected to each other, back-to-back, wherein the first and the last row of a first chess board is aligned adjacent to the first and the last row of a bordering second chess board, respectively, with the said at least two 8×8 chess boards wrapped around the said physical rotating surface;

placing four sets of 16 chess pieces on each chess board on the first two and last two rows of each chess board, wherein each set of 16 chess pieces include 1 queen, king, 2 knights, 2 bishops, 2 rooks, & 8 pawns;

providing a dividing line separating one chess board from another chess board when connected to each other and wrapped around the physical rotating surface, wherein each set of 16 chess pieces are placed on each side of the dividing line separating the chess boards;

at least two players playing the game, wherein alliances may be formed among the players, so long as there is at least one opponent player;

wherein, each player moves at least one chess piece on every turn following the conventional rules of chess, such that each player tries to capture the king(s) of the opponent player;

wherein, all the chess pieces may cross the dividing line to move onto the next chess board; and wherein, one of the pawn pieces with a distinguishing feature attains additional powers when the said pawn crosses the dividing line to move onto the next chess board.

11. The method of claim 10, wherein the distinguishing feature further includes at least one of an acoustic, optical, tactile, haptic, electrical, or visual feedback when formally revealed as a prince to the opponent.

12. The method of claim 10, wherein the said pawn with the distinguishing feature remains hidden from the opponent player(s) throughout the game unless formally revealed by the player.

13. The method of claim 10, wherein the additional powers of the said pawn further include being elevated or crowned as a king, whereby the alliance on the next chess board attains multiple kings provided the alliance's king of the next chess board has not been captured by the opponent player(s).

14. The method of claim 13, wherein the player may further transfer the elevated pawn as a king to its alliance whose king has been captured, thereby giving a second chance to the said alliance to continue to play the game.

* * * * *